United States Patent [19]

Wu et al.

[11] Patent Number: 4,786,914

[45] Date of Patent: Nov. 22, 1988

[54] MEANDERLINE POLARIZATION TWISTER

[75] Inventors: Te-Kao Wu, Rancho Palos Verdes, Calif.; Darrell L. Helms, Seminole, Fla.

[73] Assignee: E-Systems, Inc., Dallas, Tex.

[21] Appl. No.: 694,930

[22] Filed: Jan. 25, 1985

[51] Int. Cl.[4] ..... H01Q 15/24

[52] U.S. Cl. ..... 343/909; 343/756

[58] Field of Search ..... 343/756, 909

[56] References Cited

U.S. PATENT DOCUMENTS

| | | | |
|---|---|---|---|
| 3,137,000 | 6/1964 | Fuller | 343/756 |
| 3,161,879 | 12/1964 | Hannan et al. | 343/756 |
| 3,295,131 | 12/1966 | Hollingsworth | 343/909 |
| 3,340,535 | 9/1967 | Diamonte et al. | 343/756 |
| 3,754,271 | 8/1973 | Epis | 343/909 |
| 3,771,160 | 11/1973 | Laverick | 343/909 |
| 3,854,140 | 12/1974 | Ranghelli et al. | 343/756 |
| 3,975,431 | 8/1976 | White | 562/496 |
| 4,127,857 | 11/1978 | Capps et al. | 343/754 |
| 4,143,068 | 3/1979 | Findeisen | 260/545 R |
| 4,479,128 | 10/1984 | Brunner et al. | 343/909 |
| 4,599,623 | 7/1986 | Havkin | 343/781 P |

FOREIGN PATENT DOCUMENTS 44502 7/1981 European Pat. Off. .

*Primary Examiner*—William L. Sikes
*Assistant Examiner*—Michael C. Wimer
*Attorney, Agent, or Firm*—Albert M. Crowder, Jr.

[57] ABSTRACT

A polarization twister for twisting the polarization of a wide angle incident electromagnetic wave is described. Specifically, the polarization twister includes a reflector for reflecting the wide angle incident electromagnetic wave, a dielectric substrate having a longitudinal axis, a spacer bonded on a first side thereof to the dielectric substrate and on a second side thereof to the reflector, and an array of meanderline conductive strips etched on the dielectric substrate. Each meanderline conductive strip has an axis extending at a 45° angle with respect to the longitudinal axis of the dielectric substrate. In operation, the meanderline conductive strips serve to advance the phase of a parallel component of an incident E-field vector, and delay the phase of the perpendicular component thereof. Accordingly, the reflected field has its polarization twisted 90° from the incident polarization.

13 Claims, 1 Drawing Sheet

MEANDERLINE POLARIZATION TWISTER

TECHNICAL FIELD

The present invention relates generally to electromagnetic wave devices and particularly to a polarization twister for twisting the polarization of a wide angle incident electromagnetic wave.

BACKGROUND OF THE INVENTION

Polarization twisters, or "twist-reflectors", are well known in the prior art for the purpose of reflecting and twisting the polarization of an incident transverse electromagnetic (TEM) wave by 90°. Such devices are often used in Cassegrain antennas to reduce aperture blocking and feed mismatch, used in seeker antennas to provide low-inertia and rapid mechanical beam-steering, and used in space-fed arrays for the purpose of reducing unwanted specular reflections. Typically, a polarization twister is constructed by forming thin metallic strips in a parallel array on top of a quarter-wavelength thick dielectric substrate. The substrate is backed by a conducting ground plane which serves to reflect the incident wave. Such a structure is shown in U.S. Pat. No. 3,161,879 to Hannan et al. Other prior art polarization twisters include a corrugated surface or parallel plates to effect the polarization twist. However, due to their structure, such devices cannot be utilized on antennas having a curved surface; e.g., a parabolic or hyperbolic contour.

The performance of such prior art polarization twisters degrades rapidly as the incident electromagnetic wave is scanned away from normal. Specifically, such devices provide satisfactory results only if the electromagnetic wave is normally incident, plus or minus 10°, to the surface thereof. Accordingly, these devices have not been utilized for phased array antennas.

There is therefore a need to provide an improved polarization twister structure which can accommodate a wide angle incident electromagnetic wave.

SUMMARY OF THE INVENTION

In accordance with the present invention, there is provided a polarization twister for twisting the polarization of a wide angle incident electromagnetic wave. Generally, in the preferred embodiment the polarization twister includes a plurality of meanderline conductive strips, rather than parallel metallic strips, etched on a dielectric substrate. Each meanderline conductive strip has an axis extending at a 45° angle with respect to a longitudinal axis of the substrate. The device includes a reflector for reflecting the wide angle incident electromagnetic wave, and a spacer having first and second sides, the first side bonded to the dielectric substrate and the second side bonded to the reflector.

In operation, the meanderline conductive strips serve to advance the phase of a parallel component of an E-field vector of the incident electromagnetic wave, and delay the phase of a normal component thereof. Accordingly, when the incident electromagnetic wave is reflected off the reflector, these components of the E-field are 180° out of phase, thereby resulting in a 90° polarization twist of the incident electromagnetic wave. Thus, if a vertically-oriented linearly polarized wave is incident upon the polarization twister, a horizontally-oriented linearly polarized wave is reflected.

In the preferred embodiment, the dielectric substrate is a low-loss substrate formed of a polytetrafluoroethylene/fiberglass material, the spacer is formed of a low-loss dielectric foam material and the reflector is formed of aluminum. The meanderline conductive strips are preferably formed of copper and are etched onto the polytetrafluoroethylene/fiberglass substrate by printed circuit techniques.

BRIEF DESCRIPTION OF THE DRAWINGS

For a more complete understanding of the present invention and the advantages thereof, reference is now made to the following Description taken in conjunction with the accompanying Drawings in which.

DETAILED DESCRIPTION

Figure 1A:
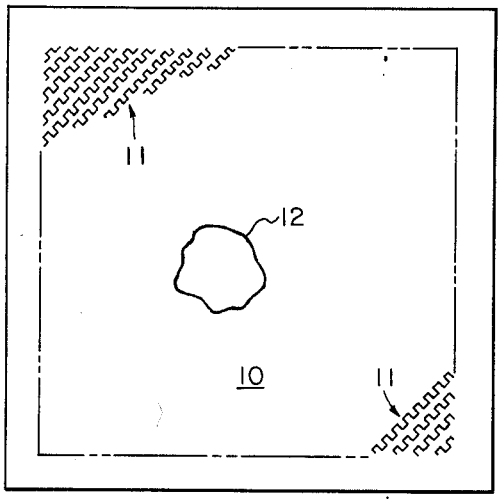
FIG. 1A is a front view of the polarization twister of the present invention showing the overall structure of an array of meanderline conductive strips.

With reference now to the Figures wherein like reference characters designate like or similar parts throughout the several views, FIG. 1A is a front view of the polarization twister 10 of the present invention having an array 11 of meanderline conductive strips. The array 11 is provided to twist the polarization of a wide angle incident electromagnetic wave; e.g., a transverse electromagnetic (TEM) wave. In a homogeneous isotropic medium, a TEM wave is an electromagnetic wave in which both the electric and magnetic field vectors are everywhere perpendicular to the direction of wave propagation. This is the normal mode of propagation in a coaxial line, or stripline. The meanderline array 11 includes a portion 12 which is shown in detail in FIG. 1B.

Figure 1B:
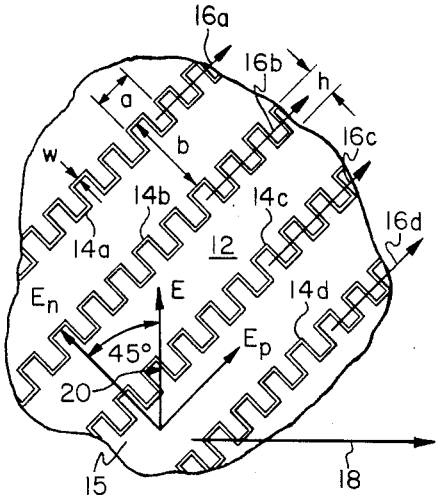
FIG. 1B is a front view of a portion of the meanderline array shown in FIG. 1A detailing the structure of the-meanderline conductive strips.

With reference now to FIG. 1B, the portion 12 of the meanderline array 11 includes a plurality of meanderline conductive strips **14*a*–14*d* etched on a dielectric substrate 15. Each meanderline conductive strip 14*a*–14*d* has an axis 16*a*–16*d*, respectively, extending at a 45° angle with respect to a longitudinal axis 18 of the polarization twister 10. As will be described in more detail below, the meanderline conductive strips are preferably formed of copper, and such conductive strips are etched by printed circuit techniques on the dielectric substrate. However, it should be appreciated that the conductive strips may be secured to the dielectric substrate 15** in any convenient fashion.

In conjunction with a reflector to be described, the meanderline conductive strips **14*a*–14*d* control the operation of the polarization twister 10. As seen in FIG. 1B, each meanderline conductive strip is physically defined by a longitudinal period "a", a distance "b" between axes of adjacent meanderline conductive strips, i.e., the period of the array 11, a transverse length "h", and a width "w" of the transversely extending legs of each meanderline conductive strip. It should also be appreciated that the portion 12 of FIG. 1B is representative of the entire array 11 shown in FIG. 1A**.

The principal of operation of the present invention can be understood by considering an incident plane wave with its electric field (E-field) vector 20 polarized at a 45° angle with respect to the meanderline axes 16. In operation, the incident electric field vector 20 is resolved into two equal components, $E_p$ and $E_n$, respectively, the component $E_p$ being parallel to the axes 16 and the component $E_n$ being perpendicular thereto. These components are in phase when the electromagnetic wave is incident on the polarization twister 10. However, by operation of the polarization twister, the phase of the parallel component $E_p$ is advanced by the meanderline conductive strips **14*a*–14*d*** while the phase of the perpendicular component $E_n$ is delayed. Accordingly, when the two components $E_p$ and $E_n$ are reflected, they are 180° out of phase. Therefore, the reflected E-field vector, i.e., the resultant vector derived from the components $E_p$ and $E_n$, has its polarization twisted 90° from the incident polarization.

Figure 2:
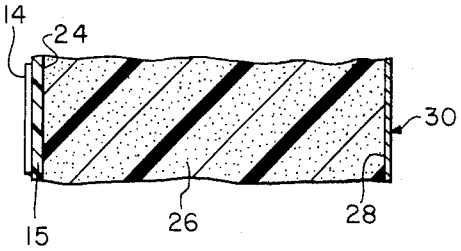
FIG. 2 is a side view of the preferred structural configuration of the polarization twister of FIG. 1A.

Referring now to FIG. 2, a side view is shown of the preferred configuration of the polarization twister 10 of FIG. 1. Specifically, the polarization twister 10 includes the dielectric substrate 15 upon which the meanderline conductive strips of the array 11 are etched by printed circuit techniques. In accordance with the preferred embodiment of the invention, the dielectric substrate 15 is formed of a low-loss polytetrafluoroethylene/fiberglass material. The substrate 15 is bonded in any conventional fashion to a first side 24 of a spacer 26, which is preferably formed of a low-loss dielectric foam material. The spacer 26 includes a second side 28 to which is bonded a reflector 30 for reflecting the incident electromagnetic wave. The reflector 30 is preferably formed of aluminum.

Referring simultaneously to FIGS. 1B and 2, in operation of the present invention the parallel and perpendicular components $E_p$ and $E_n$ of the E-field vector 20 are in phase when the electromagnetic wave is incident upon the meanderline array 11 etched on the dielectric substrate 15. As discussed above, the phase of the parallel component $E_p$ is advanced by the meanderline conductive strips **14*a*–14*d* while the phase of the perpendicular component $E_n$ is delayed. After these components are reflected by the reflector 30, they are 180° out of phase if the correct meanderline dimensions and substrate thickness are utilized for the polarization twister 10**. Accordingly, the resultant reflected E-field vector has its polarization twisted 90° from the incident polarization thereof.

Figure 3A:
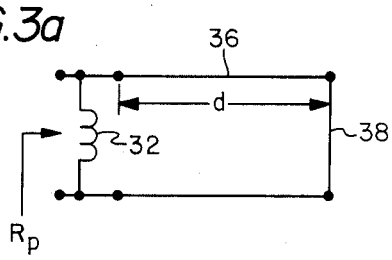
FIGS. 3A and 3B are transmission line equivalent circuits for a meanderline conductive strip of the polarization twister of FIG. 1B.
Figure 3B:
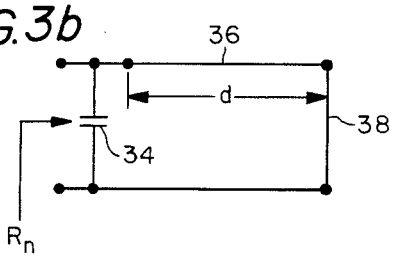

To determine the correct meanderline dimensions and substrate thickness, the transmission line models of FIGS. 3A and 3B are shown. These models represent the parallel and perpendicular vector components, respectively, of the incident E-field vector 20. As seen in FIG. 3A, since the meanderline conductive strips 14 provide phase advance for the parallel component $E_p$ of the incident E-field vector 20, a shunt inductance 32 is used to model these strips. Likewise, since the meanderline conductive strips 14 provide phase delay for the perpendicular component $E_n$ of the incident E-field vector 20, a shunt capacitance 34 is used in FIG. 3B. The overall thickness of the polarization twister 10 of FIG. 2 is modeled in both FIGS. 3A and 3B by a section of transmission line 36, having a length "d", terminated in a short circuit 38.

Via an impedance transformation, the section 36 of transmission line in FIGS. 3A and 3B transforms into a parallel normalized susceptance B for the parallel and perpendicular cases of:

$$B = -j \cot(\beta d), \tag{1}$$

where $\beta = 2\pi/\lambda$ and $\lambda = c/f$. According to the present invention, it has been found that the meanderline susceptances required for optimum performance of the polarization twister at an operating frequency of f = 10 GHz are:

$$B_p = -j\,1.4 \tag{2}$$

$$B_n = j\,0.6 \tag{3}$$

As noted above, in order to ensure that the reflected field polarization is twisted 90°, the parallel and perpendicular components $E_p$ and $E_n$ of the E-field vector 20 must be advanced and delayed, respectively, such that these components are 180° out of phase when reflected off the reflector 30. For the desired meanderline susceptances of equations (2) and (3) at f = 10 GHz, this is achieved by moving the respective susceptances $B_p$ and $B_n$ by j0.4, to:

$$B'_p = -j1.0, \tag{4}$$

$$B'_n = j1.0 \tag{5}$$

respectively. Such movement places the susceptances shown in equations (4) and (5) on a straight line through the center of a Smith chart representation. Thus reflection coefficients $R_p$ and $R_n$ of FIGS. 3A and 3B are 180° out of phase.

Using equation (1), the thickness d of the polarization twister 10 required to move the susceptances by j0.4 is then determined as:

$$B = -j \cot(\beta d) = j\,0.4,$$

$$\text{or } d = 0.31/\lambda = 0.365'' \text{ (at f = 10 GHz).}$$

Figure 4:
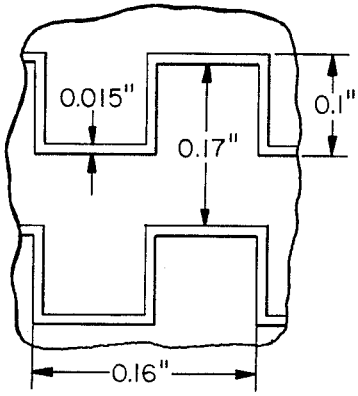
FIG. 4 is a detailed front view of the preferred meanderline conductive strip dimensions in inches at an operating frequency of 10 GHz for the polarization twister of FIG. 1B.

It can also be shown that, given the meanderline dimensions a, b, h and w in inches of FIG. 4, one can arrive at the normalized susceptances $B_p$ and $B_n$ of equations (2) and (3) via the following equations:

$$B_p = \frac{1}{X_p} = -j1.4, \tag{6}$$

$$X_p = \frac{b}{\lambda\left[1 - \left(\frac{fh}{5.62}\right)^2\right]}\left\{k_1 \ln\left[\csc\left(\frac{\pi w}{2b}\right)\right] + \frac{2h}{a}\ln\frac{4a}{\pi w} - 0.492\right\},$$

where $$\lambda = \frac{11.8}{f},\ k_1 = 1; \tag{7}$$

$$B_n = \frac{8\pi M k_2}{ab\lambda}\left\{\frac{1}{1 - \left(\frac{f}{f_r}\right)^2}\right\},$$

-continued where:

$$f_r = 11.8/\sqrt{\frac{8\pi M}{b}\ln\left[csc\left(\frac{\pi w}{a}\right)\right]},$$

$$M = h^3\left(0.11\frac{a}{h} + 0.048\right),\ k_2 = 3.4.$$

In the preferred embodiment, the meanderline conductive strips 14 are etched on an approximately 0.02" thick (0.017λ) polytetrafluoroethylene/fiberglass substrate 15 having a dielectric constant $\epsilon_r=2.48$ and size 8"×8". The foam spacer 26 has a dielectric constant $\epsilon_r=1.05$ such that the thickness "x" thereof can then be determined from:

$$d=0.365''=[0.02''(2.48)^{\frac{1}{2}}+x(1.05)^{\frac{1}{2}}]\text{or}$$
$$x=0.325''=0.275\lambda.$$

Generalizing to all frequencies, construction of the polarization twister 10 according to the wavelength dimensions set forth below in Table I ensures that the polarization of wide angle incident electromagnetic waves are twisted by the twister 10:

TABLE I

| Parameter | Dimension (in λ) |
|---|---|
| substrate thickness | 0.017 |
| spacer thickness | 0.275 |
| device thickness d | 0.31 |
| a | 0.1356 |
| b | 0.144 |
| h | 0.0847 |
| w | 0.0127 |

Accordingly, it can be seen that the present invention is advantageous since it provides a polarization twister that operates at a wide angle. This efficiency can be explained by referring to the transmission line models shown in FIGS. 3A and 3B. Specifically, as the electromagnetic wave is obliquely incident on the polarization twister, the susceptance B is increased by ΔB. Meanwhile, the meanderline susceptance $B_n$ is decreased by $\Delta B_n$; likewise the meanderline susceptance $B_p$ is increased by $\Delta B_p$. Since $\Delta B_n$, $\Delta B_p$ and ΔB are nearly identical, the resultant susceptances $B_n'$ and $B_p'$ are always approximately equal to j1.0 and −j1.0, respectively. Accordingly, the reflection coefficients $R_n$ and $R_p$ are always 180° out of phase as the incident angle varies from normal incidence. The resultant reflected E-field vector is then observed with its polarization twisted 90° from the incident polarization even for wide scanning angles.

Therefore, according to the present invention a polarization twister is provided for twisting the polarization of a wide angle incident electromagnetic wave. The polarization twister comprises an array of meanderline conductive strips etched on a dielectric substrate, each conductive strip having an axis extending at a 45° angle with respect to a longitudinal axis of the dielectric substrate. The polarization twister further includes a low-loss spacer bonded on a first side thereof to the dielectric substrate, and on a second side thereof to a reflector for reflecting the wide angle incident electromagnetic wave. In operation, properly dimensioned meanderline conductive strips serve to advance the phase of the parallel component and delay the phase of the perpendicular component of the incident E-field vector of the electromagnetic wave. Accordingly, these components are 180° out of phase upon reflection from the reflector, and thus the resultant reflected field has its polarization twisted 90° from the incident polarization.

The present invention is thus much more advantageous than conventional polarization twisters, which cannot be used in wide-angle scanning since the performance thereof degrades rapidly as the incident wave is scanned away from normal incidence. Moreover, the described polarization twister is lightweight and simple in hardware design, and thus is inexpensive to manufacture.

Although in the preferred embodiment of the invention the dielectric substrate 15 is formed of a polytetrafluoroethylene/fiberglass material, the spacer 26 of a foam material, and the reflector 30 of aluminum, those skilled in the art will recognize that such materials are not meant to be limiting. According to the present invention, functionally equivalent materials may be utilized in the polarization twister design configuration.

Although the invention has been described in detail, it is to be clearly understood that the same is by way of illustration and example only, and is not to be taken by way of limitation, the spirit and scope of the invention being limited onlt to the terms of the appended claims.

We claim:

1. A wide angle polarization twister fo twisting the polarization of an incident electromagnetic wave of wavelength λ, comprising:

a dielectric substrate having a longitudinal axis and a dimension in thickness equal to 0.017λ;

a spacer having first and second sides and a dimension "x" given by the expression x=0.275 λ, said dielectric substrate bonded to the first side of the spacer;

a single layer of a plurality of meanderline conductive strips etched on said dielectric substrate, each meanderline conductive strip having a width "d"=0.31 λ and an axis extending at a 45° angle with respect to the longitudial axis of said dielectric substrate;

a reflector bonded to the second side of the spacer for reflecting the wide angle incident electromagnetic wave with its polarization twisted 90°; and wherein each of the meanderline conductive strips has a longitudinal period "a", a distance "b", a transverse length "h", and a width "w" determined by the wavelength λ to provide the 90° twist of the electromagnetic wave by the single layer of meanderline conductive strips.

2. The polarization twister as described in claim 1 wherein said incident electromagnetic wave includes an electric field vector having parallel and perpendicular components, said meanderline conductive strips including means for advancing a phase of said parallel component and means for delaying the phase of said perpendiclar component.

3. The polarization twister as described in claim 2 wherein when said incident electromagnetic wave is reflected off said reflector, said parallel and perpendicular components of said electric field vector are 180° out of phase, thereby resulting in said 90° polarization twist.

4. The polarization twister as described in claim 1 wherein said dielectric substrate is formed from a low-loss polytetrafluoroethylene/fiberglass material.

5. The polarization twister as described in claim 4 wherein the polytetrafluoroethylene/fiberglass dielectric substrate has a thickness approximately $=0.017\lambda$.

6. The polarization twister as described in claim 1 wherein said spacer is formed of a low-loss foam material.

7. The polarization twister as described in claim 6 wherein said foam spacer has a thickness approximately $=0.275\lambda$.

8. The polarization twister as described in claim 1 wherein said reflector is formed of aluminum.

9. The polarization twister as described in claim 1 wherein each of said meanderline conductive strips is a copper strip etched by printed circuit techniques on said dielectric substrate.

10. The polarization twister as described in claim 1 wherein each of said meanderline conductive strips has a longitudinal period approximately $=0.1356\lambda$.

11. The polarization twister as described in claim 1 wherein said meanderline conductive strips are formed on said dielectric substrate at a distance approximately $=0.144\lambda$ apart from each other.

12. The polarization twister as described in claim 1 wherein each of said meanderline conductive strips has a transverse length approximately $=0.0847\lambda$.

13. The polarization twister as described in claim 1 where each of said meanderline conductive strips has a width approximately $=0.0127\lambda$.

* * * * *